US007786963B2

(12) United States Patent
Hong et al.

(10) Patent No.: US 7,786,963 B2
(45) Date of Patent: Aug. 31, 2010

(54) METHOD AND APPARATUS FOR DRIVING LIQUID CRYSTAL DISPLAY DEVICE HAVING DATA CORRECTION FUNCTION

(75) Inventors: Hee Jung Hong, Seoul (KR); Kyung Joon Kwon, Seoul (KR)

(73) Assignee: LG Displays Co., Ltd., Seoul (KR)

( * ) Notice: Subject to any disclaimer, the term of this patent is extended or adjusted under 35 U.S.C. 154(b) by 1024 days.

(21) Appl. No.: 11/288,262

(22) Filed: Nov. 29, 2005

(65) Prior Publication Data

US 2006/0139270 A1 Jun. 29, 2006

(30) Foreign Application Priority Data

Dec. 29, 2004 (KR) ..... 10-2004-0115740

(51) Int. Cl.
*G09G 3/36* (2006.01)
*G09G 5/10* (2006.01)

(52) U.S. Cl. ..... 345/89; 345/690

(58) Field of Classification Search ..... 345/87–107, 345/589–605, 690
See application file for complete search history.

(56) References Cited

U.S. PATENT DOCUMENTS

| | | | | |
|---|---|---|---|---|
| 5,349,226 | A | 9/1994 | Kawaguchi et al. | 257/347 |
| 6,636,229 | B2 * | 10/2003 | Ishikawa et al. | 345/593 |
| 6,778,183 | B1 * | 8/2004 | Nair et al. | 345/589 |
| 6,801,178 | B2 * | 10/2004 | Nitta et al. | 345/89 |
| 6,850,214 | B2 * | 2/2005 | Nishitani et al. | 345/87 |
| 7,034,843 | B2 * | 4/2006 | Nair et al. | 345/589 |
| 7,046,252 | B2 * | 5/2006 | Nair et al. | 345/590 |
| 7,113,163 | B2 * | 9/2006 | Nitta et al. | 345/102 |
| 7,245,308 | B2 * | 7/2007 | Kiuchi et al. | 345/589 |
| 7,317,462 | B2 * | 1/2008 | Lu et al. | 345/89 |
| 2002/0011979 | A1 * | 1/2002 | Nitta et al. | 345/89 |
| 2002/0036626 | A1 | 3/2002 | Tsutsui | 345/204 |
| 2004/0207589 | A1 * | 10/2004 | Kim et al. | 345/89 |

FOREIGN PATENT DOCUMENTS

| | | |
|---|---|---|
| CN | 1345024 | 4/2002 |
| JP | 2004-302311 | 10/2004 |

OTHER PUBLICATIONS

Park et al,"A Novel Method for Image Contrast Enhancement in TFT-LCDs: Dynamic Gamma Control (DGC)", SID 03 Digest, pp. 1343-1345, 2003.*

* cited by examiner

*Primary Examiner*—Chanh Nguyen
*Assistant Examiner*—Adam J Snyder
(74) *Attorney, Agent, or Firm*—Morgan Lewis & Bockius LLP

(57) ABSTRACT

A method and an apparatus for driving a display device including a histogram calculator to calculate a histogram of pixel data for an input image and a data stretching curve generator, which divides the histogram into n (n being a positive integer above 2) gray level areas to generate a data stretching curve for each gray level area of which a gradient is determined in proportion to a total number of pixel data accumulated for each of the gray level areas, and modulates the pixel data of the input image with the generated data stretching curve.

9 Claims, 7 Drawing Sheets

METHOD AND APPARATUS FOR DRIVING LIQUID CRYSTAL DISPLAY DEVICE HAVING DATA CORRECTION FUNCTION

This application claims the benefit of the Korean Patent Application No. P2004-115740 filed on Dec. 29, 2004, which is hereby incorporated by reference.

BACKGROUND OF THE INVENTION

1. Field of the Invention

The present invention relates to a liquid crystal display device, and more particularly to a liquid crystal display device that is adapted for displaying a detailed expression of an image, and a driving method thereof.

2. Discussion of the Related Art

A liquid crystal display device controls the light transmissivity of liquid crystal cells in accordance with a video signal to display a picture. An active matrix type of liquid crystal display device is advantageous in displaying a motion picture because such a device utilizes active control of switching devices. A thin film transistor is mainly used as the switching device in the active matrix type of liquid crystal display device.

Recently, application of liquid crystal display devices has expanded from being used as monitors and display devices in office equipment to televisions. Accordingly, manufacturers of liquid crystal display devices have been investing heavily in improving picture quality to compete with existing cathode ray tubes (CRTs). As part of increasing picture quality, various methods of improving contrast ratio and brightness have been proposed.

FIG. 1 represents a related art data stretching device. As shown in FIG. 1, the data stretching device includes a histogram analysis part 12 (i.e., an on-screen-display (OSD) input part), a stretching curve selection part 11, and N number of data stretching curves 13(1) to 13(N). The histogram analysis part 12 calculates the histogram of an input digital video data RGB(IN), i.e., the frequency distribution function by gray levels. The histogram analysis part 12 supplies an OSD stretching selection command inputted from a user and/or a calculated histogram result to the stretching curve selection part 11. The stretching curve selection part 11 selects any one of the N number of data stretching curves 13(1) to 13(N) in accordance with the OSD stretching selection command or the histogram result from the histogram analysis part 12.

Pre-set stretching curves different from each other are stored as the data stretching curves 13(1) to 13(N). Any one of the curves 13(1) to 13(N) is selected by the stretching curve selection part 11. The data RGB(IN) is modulated by a selected one of a stretching curve 13(1) to 13(N) by the stretching curve selection part 11. The data stretching curves 13(1) to 13(N) are each made up of a lookup table stored in memory 13 and use the RGB(IN) data from the stretching curve selection part 11 as an address to output a stretching data corresponding to the RGB(IN) data. However, in the related art data stretching device, picture quality may worsen in accordance with the image, and the ability to express the gray levels in detail is difficult.

SUMMARY OF THE INVENTION

Accordingly, the present invention is directed to a method and apparatus for driving a liquid crystal display device that substantially obviates one or more problems due to limitations and disadvantages of the related art.

It is an object of the present invention to provide a liquid crystal display device that is adapted to increase picture quality for enabling a detailed expression of an image, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the apparatus for driving a display device, including a histogram calculator to calculate a histogram of pixel data for an input image and a data stretching curve generator, which divides the histogram into n (n being a positive integer above 2) gray level areas to generate a data stretching curve for each gray level area of which a gradient is determined in proportion to a total number of pixel data accumulated for each of the gray level areas, and modulates the pixel data of the input image with the generated data stretching curve.

In another aspect, the present invention includes a liquid crystal display device, includes a liquid crystal display panel, a histogram calculator to calculate a histogram of pixel data for an input image, a data stretching curve generator, which divides the histogram into n (n being a positive integer above 2) gray level areas to generate a data stretching curve for each gray level area of which a gradient is determined in proportion to a total number of pixel data accumulated for each of the gray level areas, and modulates the pixel data of the input image with the generated data stretching curve, a data driver to supply the modulated pixel data to the liquid crystal display panel, a gate driver to supply a scan pulse to the liquid crystal display panel, and a timing controller to supply the modulated pixel data to the data driver and control the data driver and the gate driver.

In yet another aspect, a driving method of a liquid crystal display device, comprising the steps of calculating a histogram of pixel data for an input image, dividing the histogram into n (n being a positive integer above 2) gray level areas, generating a data stretching curve for each gray level area of which a gradient is determined in proportion to a total number of pixel data accumulated for each of the gray level areas, and modulating the pixel data of the input image with the data stretching curve.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the present invention, examples of which are illustrated in the accompanying drawings. With references to FIGS. 2 to 7, the exemplary embodiments of the present invention will be explained as follows.

Figure 1:
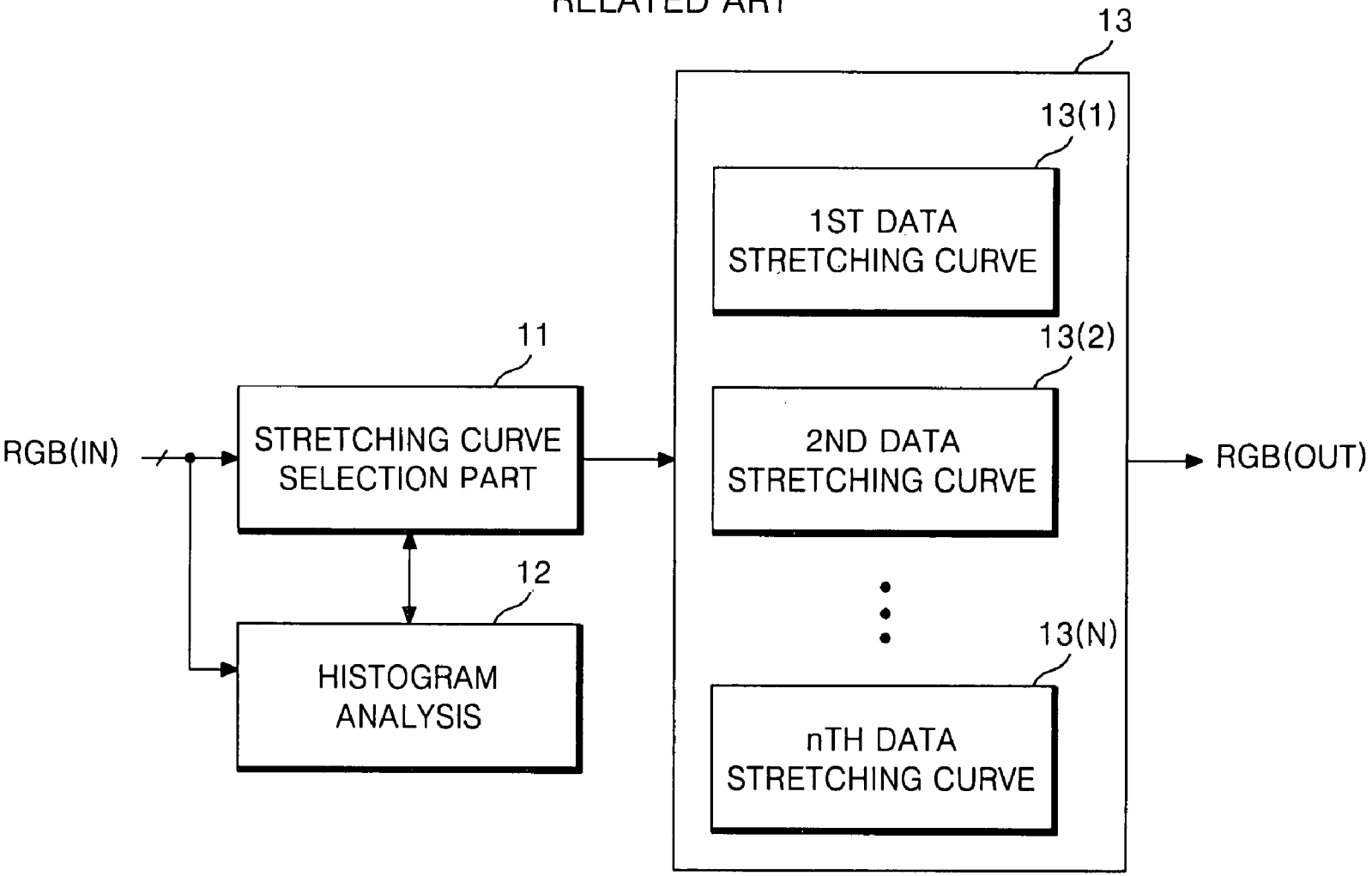
FIG. 1 RELATED ART
FIG. 1 is a block diagram representing a related art data stretching device.
Figure 2:
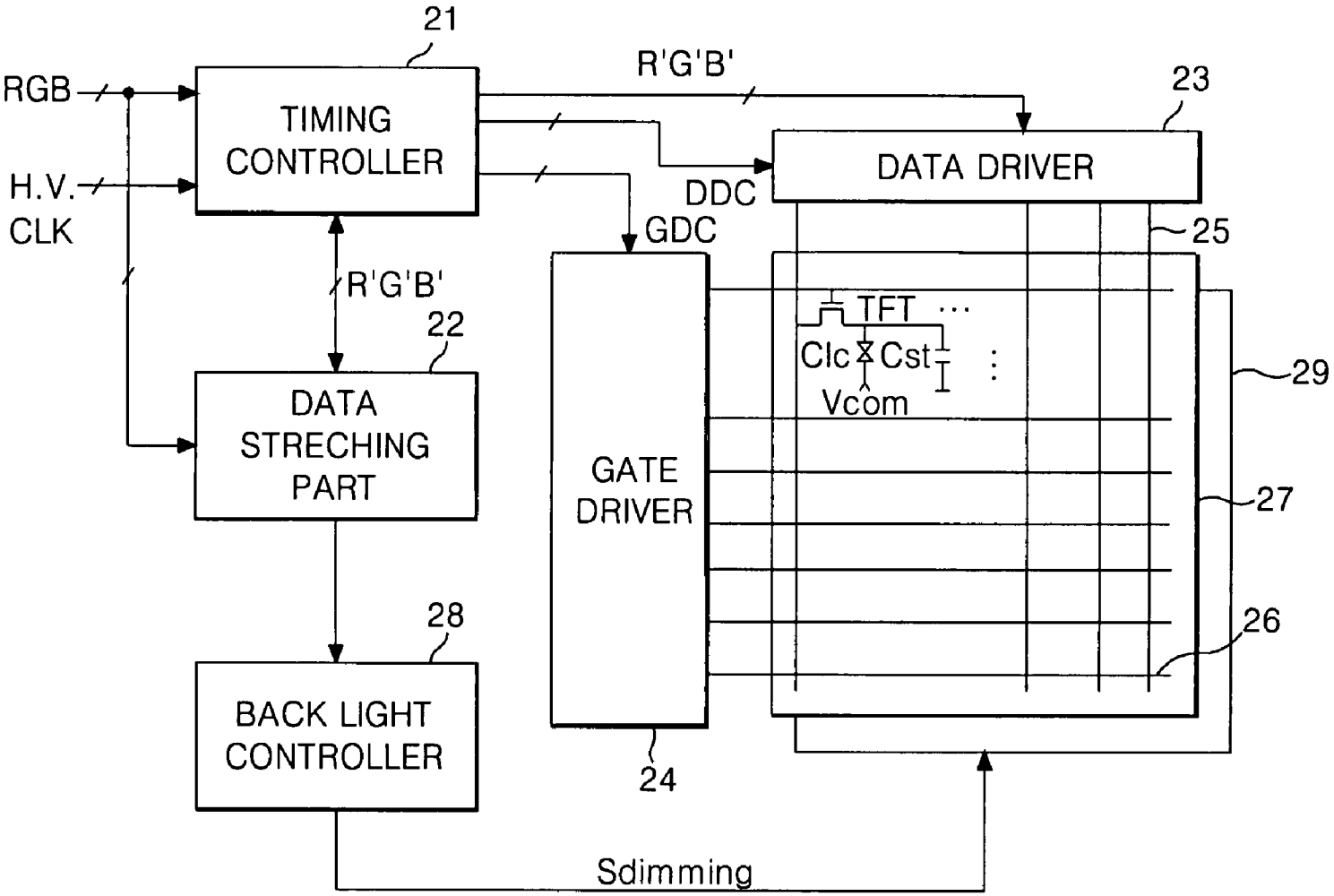
FIG. 2 is a block diagram representing a liquid crystal display device according to an exemplary embodiment of the present invention.

As shown in FIG. 2, a liquid crystal display according to the present invention includes a liquid crystal display panel 27 where data lines 25 crosses gate lines 26 and a thin film transistor TFT for driving a liquid crystal cell Clc is formed at each intersection. A data driver 23 for supplying data to the data lines 25 of the liquid crystal display panel 27 and a gate driver 24 for supplying a scan pulse to the gate lines 26 of the liquid crystal display panel 27 are also included.

A data stretching part 22 calculates a histogram for the data of an input image and performs data stretching in correspondence with the total number of pixel data in each gray level area, where the histogram is divided into n (n being a positive integer above 2) number of areas. A backlight controller 28 controls the brightness of the backlight 29 in accordance with the result of the histogram analysis of the image data. A timing controller 21 supplies the stretched digital video data R'G'B' to the data driver 23 and controls the data driver 23 and the gate driver 24.

In the liquid crystal display panel 27, liquid crystal is injected between two glass substrates, and the data lines 25 and the gate lines 26 are formed to cross each other perpendicularly on the lower glass substrate, for example. The TFT formed at the intersection of the data lines 25 and the gate lines 26 responds to the scan pulse from the gate line 26 to supply the data from the data line 25 to the liquid crystal cell Clc. To supply the image data to the liquid crystal cell Clc, the gate electrode of the TFT is connected to the corresponding gate line 26 and the source electrode is connected to the corresponding data line 25. The drain electrode of the TFT is connected to a pixel electrode of the liquid crystal cell Clc. Further, a storage capacitor Cst is formed on the lower glass substrate, for example, to sustain a voltage of the liquid crystal cell Clc. The storage capacitor Cst may be formed between the liquid crystal cell Clc and a previous gate line 26, for example, or may be formed between the liquid crystal cell Clc and a separate common line. Other configurations of the storage capacitor Cst may be used.

The backlight 29 may be a direct type backlight or an edge type backlight. A light emitting diode, a cold cathode fluorescent lamp (CCFL), an external electrode fluorescent lamp (EEFL), and other types of light sources may be used as the backlight 29. The brightness of the light source in the backlight 29 may be controlled in accordance with a driving dimming signal Sdimming supplied from the backlight controller 28.

The data driver 23 includes a register (not shown) for temporarily storing the stretched digital video data R'G'B' from the timing controller 21 and a latch (not shown) for storing the data of one line in response to a clock signal from a shift register (not shown) and simultaneously outputting the stored data of one line, for example. A digital/analog converter (not shown) selects an analog positive/negative gamma compensation voltage in correspondence to a digital data value from the latch. A multiplexer (not shown) selects the data line 25 to which the positive/negative gamma compensation voltage is to be supplied, and an output buffer (not shown) is connected between the multiplexer and the data line. The data driver 23 receives the stretched digital video data R'G'B' and supplies the data R'G'B' to the data lines 25 of the liquid crystal display panel 27 in synchronization with the scan pulse under the timing controller 21.

The gate driver 24 includes a shift register (not shown) for sequentially generating a scan pulse in response to a gate control signal GDC from the timing controller 21. A level shifter (not shown) for shifting a swing width of the scan pulse to a suitable level for driving the liquid crystal cell Clc and an output buffer (not shown) are also included. The gate driver 24 supplies the scan pulse to the gate line 26 for activating the TFTs connected to the gate line 26 in selecting the liquid crystal cells Clc of one horizontal line to which a pixel voltage of the image data, i.e., the analog gamma compensation voltage, is to be supplied. The data generated from the data driver 23 are supplied to the liquid crystal cells Clc of the horizontal line selected by the scan pulse.

The data stretching part 22 calculates a histogram, i.e., pixel distribution by gray levels, for each screen. The data stretching part 22 selects a data stretching curve, of which the gradient increases in proportion to the total number of pixel data for each pre-set area. The data stretching part 22 modulates the digital video data of the input image to the data stretching curve selected for each area to extend a dynamic range and contrast of the input image. Further, the data stretching part 22 selects a data stretching curve of a pre-set minimum gradient in an area where the pixel data number is smaller than a minimum critical value in the histogram and a data stretching curve of a pre-set maximum gradient in an area where the pixel data number is greater than a maximum critical value, thereby enabling a detailed gray level expression in the whole gray level range. The data stretching part 22 also generates a control signal for controlling the brightness of the backlight 29 in accordance with the histogram and supplies the control signal to the backlight controller 28. The data stretching part 22 may be embedded in the timing controller 21 as an integrated circuit.

The backlight controller 28 includes a plurality of inverters (not shown), which generate the driving power of the backlight 29 with current or voltage. The backlight controller 28 controls the output of the inverters in response to the control signal from the data stretching part 22 to supply to the backlight 29 the driving dimming signal Sdimming for increasing the brightness of the backlight 29 for a bright image and decreasing the brightness of the backlight 29 for a relatively dark image. The backlight controller 28 divides one screen into a plurality of blocks so that the brightness of the backlight 29 may be controlled by blocks in accordance with the histogram analysis result for the image of the block corresponding to the light source of each block.

Figure 3:
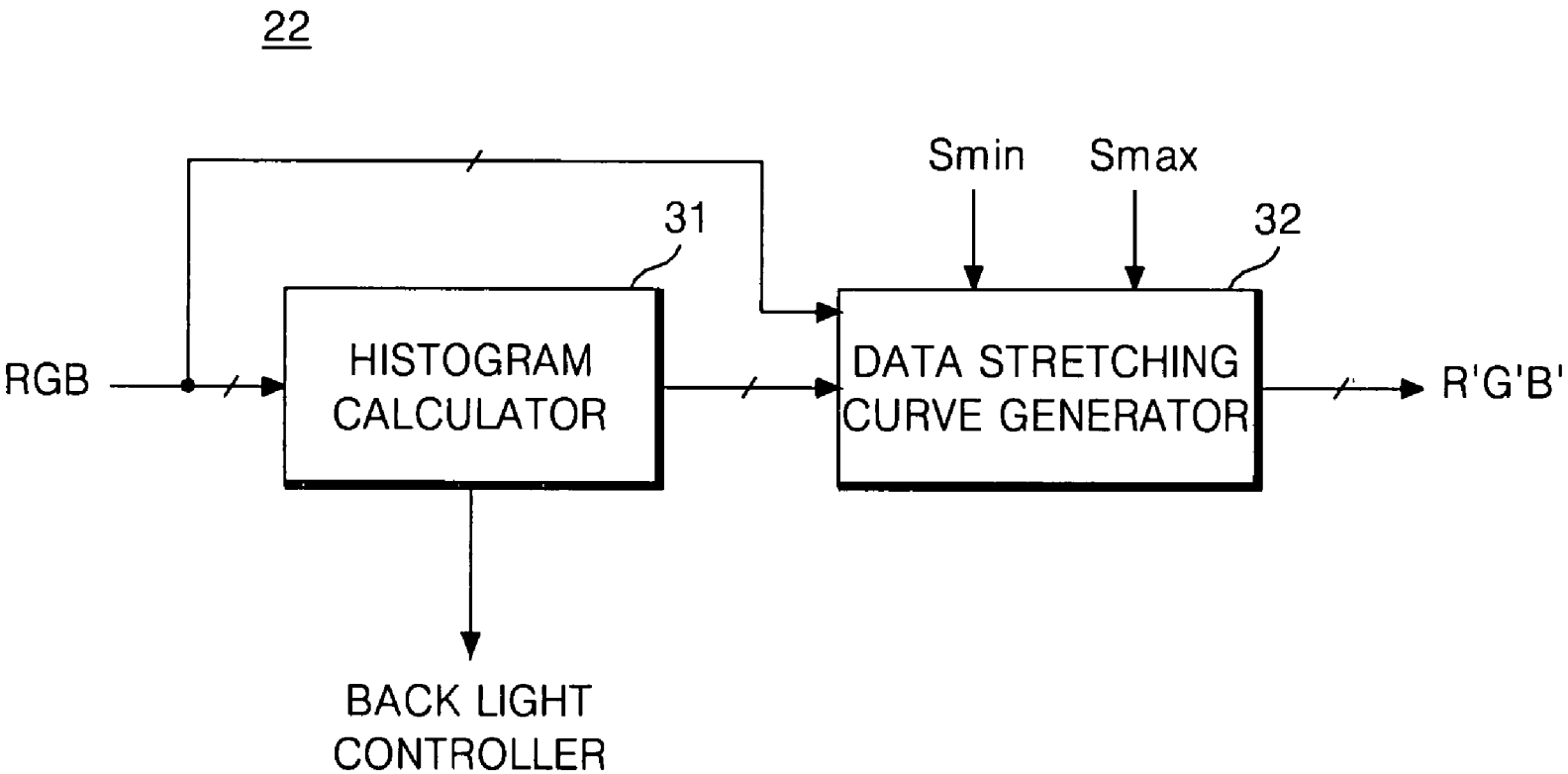
FIG. 3 is a block diagram representing an exemplary data stretching part shown in FIG. 2 in detail.

FIG. 3 represents an exemplary embodiment of the data stretching part 22 in detail. As shown in FIG. 3, the data stretching part 22 includes a histogram calculator 31 and a data stretching curve generator 32. The histogram calculator 31 calculates the histogram for each screen corresponding to the input image and supplies the calculated histogram to the data stretching curve generator 32 and the backlight controller 28.

The data stretching curve generator 32 divides the histogram into n gray level areas and generates a data stretching curve for each gray level area having a gradient proportional to the total number of pixel data in each of the divided gray level areas. The gradient of the data stretching curve is defined as:

$$\text{gradient}=\text{output gray level}(y1)/\text{input gray level}(x1) \quad \text{[eq. 1].}$$

Figure 4:
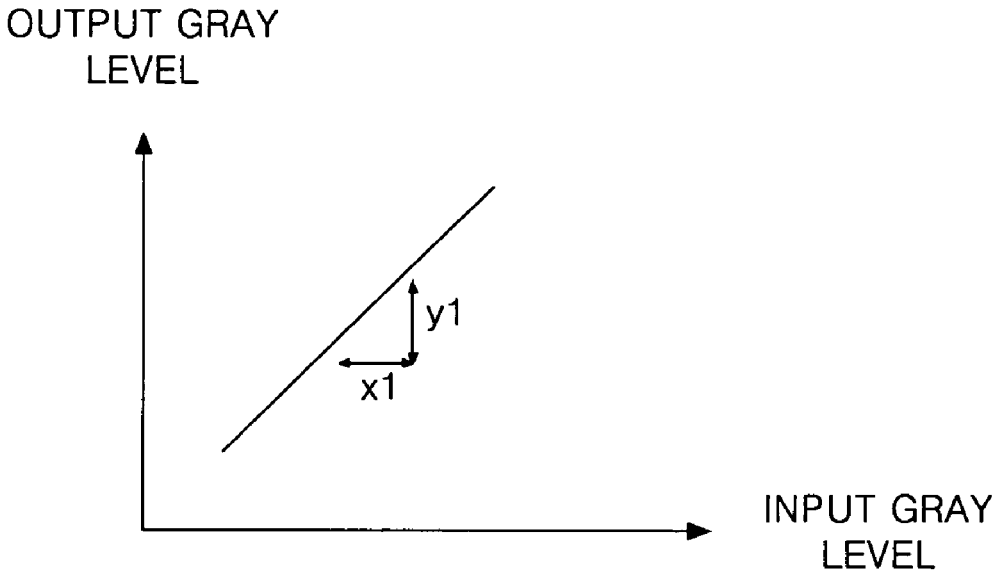
FIG. 4 is a graph representing an exemplary gradient of a data stretching curve.

As illustrated in FIG. 4, the gradient becomes greater to increase the expression power of the corresponding gray level as the total number of pixel data included in each gray level area becomes larger. The gradient of the data stretching curve in each gray level area is determined between the pre-set minimum gradient Smin and the pre-set maximum gradient Smax. According to the experimental results, the minimum gradient Smin suitable for a minute gray level expression is within the range of 0.55 to 0.95, preferably at 0.75, and the maximum gradient Smax is within the range of 1.3 to 1.7, preferably at 1.5.

The data stretching curve generator 32 connects the data stretching curves determined for each of the n gray level areas divided within the histogram. The connection is made by connecting the end point of the data stretching curve determined for the mth (where m is an integer smaller than n) gray level area to the starting point of the data stretching curve of (m+1)th gray level area. Once the data stretching curve of each of the gray level areas divided within the histogram is connected, the data stretching curve generator 32 generates the modulated data R'G'B' by mapping the input digital video data RGB to the data stretching curve determined in all gray levels in the manner mentioned above. The data stretching curve generator 32 then supplies the modulated data R'G'B' to the timing controller 21.

Figure 5:
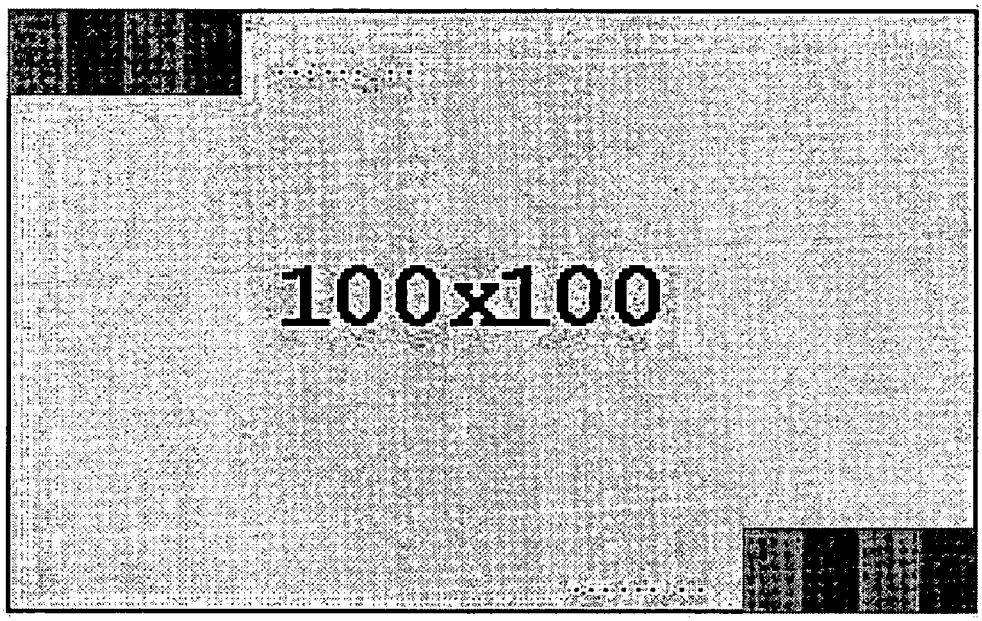
FIG. 5 is a diagram representing a liquid crystal display panel of 100×100 resolution.

An example of data stretching according to an exemplary embodiment of the present invention will be explained in conjunction with FIGS. 5 and 7. As illustrated in FIG. 5, for example, if the resolution of the liquid crystal display panel 27 is 100×100, the number of pixel data of one screen is 10,000, on which an image of 256 gray levels is displayed by 8 bit data and the histogram is divided into 5 gray level areas. If it is further assumed, for illustrative purposes only, that the result of calculating the accumulated number of pixel data per gray level area in the histogram for one frame data of the image to be inputted to the liquid crystal display panel is as shown in the first graph of FIG. 6.

Figure 6:
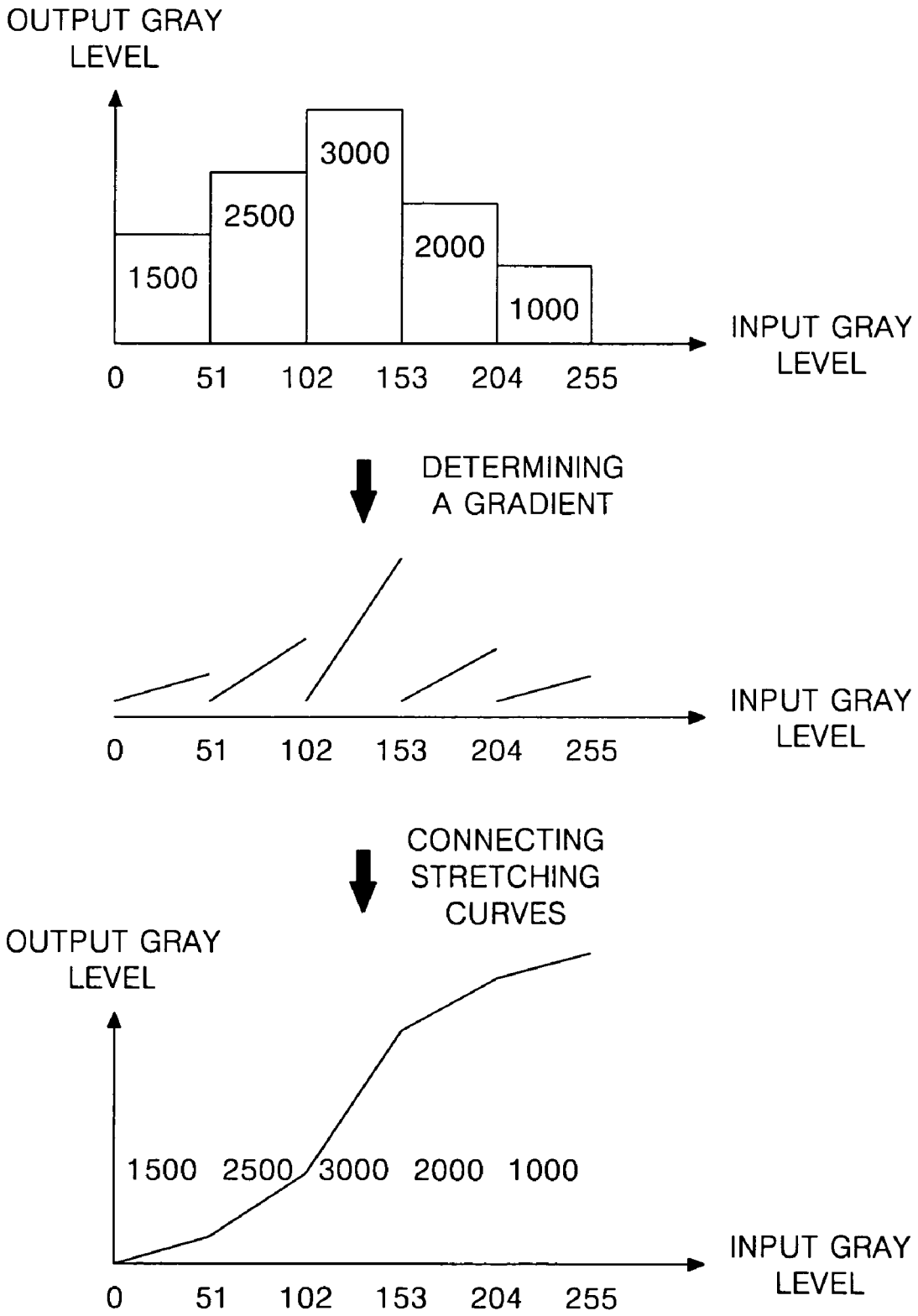
FIG. 6 is a diagram representing one example of data stretching according to an exemplary embodiment of the present invention.

The first graph of FIG. 6 illustrates an exemplary histogram according to a first example. The first example includes image data with 1500 pixel data having a first gray level of 0 to 51, 2500 pixel data having a second gray level of 52 to 102, 3000 pixel data having a third gray level of 103 to 153, 2000 pixel data having a fourth gray level of 154 to 204, and 1000 pixel data having a fifth gray level of 205 to 255. Based on this exemplary image data, the data stretching part 22 generates the histogram categorizing the total number of pixel data in each gray level area as illustrated in the first graph of FIG. 6.

The data stretching part 22 then determines the gradient of the data stretching curve to be the biggest below the maximum gradient Smax in order to broaden the gray level expression range in the third gray level area in which the number of pixel data is the largest. As illustrated in the second graph of FIG. 6, the data stretching part 22 determines the gradient of the data stretching curve to be the greatest in the third gray level area, then the second gray level area, then the fourth gray level area, then the first gray level area, and lastly the fifth gray level area in proportion to the total number of pixel data accumulated within each gray level area.

The data stretching part 22 then completes the data stretching curve, as illustrated in the last graph of FIG. 6, for the whole gray level range, i.e., 256 gray levels, by connecting the end points of the data stretching curves in the preceding gray level area to the starting point of the data stretching curve of the following gray level area. The data stretching part 22 finally maps the input image to the generated exemplary data stretching curve as illustrated in FIG. 6 to modulate the data and supplies the modulated data R'G'B' to the timing controller 21.

Figure 7:
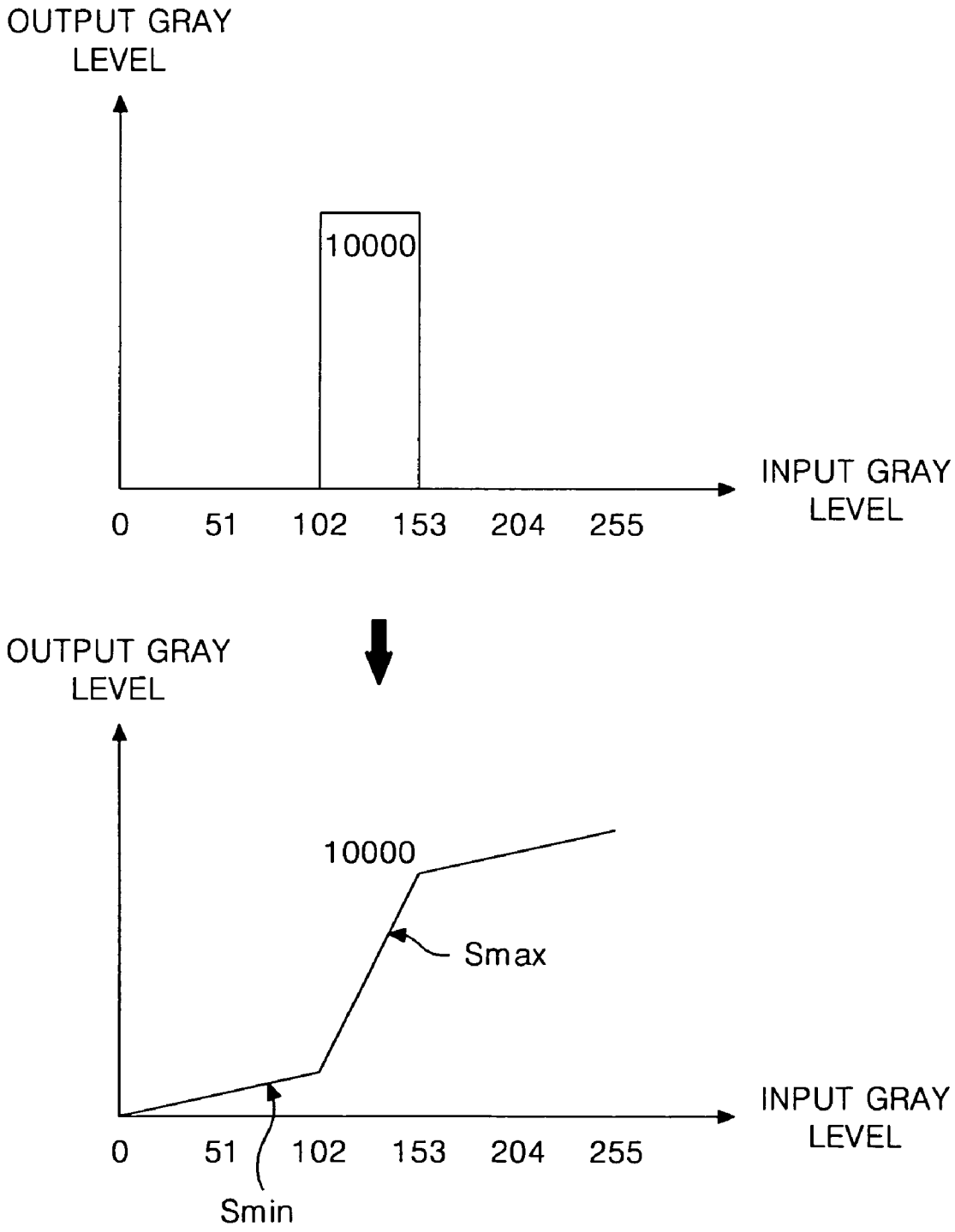
FIG. 7 is a diagram representing another example of data stretching according to another exemplary embodiment of the present invention.

FIG. 7 represents a histogram of an image where data are concentrated in a specific gray level range and a data stretching curve selected as a result of the histogram calculation. A result of a histogram calculation for one frame data of an image to be inputted to the liquid crystal display panel 27 of FIG. 5 is illustrated in the first graph of FIG. 7 based on the example of 10000 total pixel data of one screen all having a third gray level of 103~153. Then, as illustrated in the second graph of FIG. 7, the data stretching part 22 sets the gradient of the data stretching curve to be the maximum gradient Smax in order to broaden the gray level expression range in the third gray level area where the number of pixel data is the largest and sets the gradient of the data stretching curve to be the minimum gradient Smin in the other gray level areas. The end point of the data stretching curve of the preceding gray level area is connected to the starting point of the data stretching curve of the following gray level area. Thereafter, the data stretching part 22 maps the input image to the generated exemplary data stretching curve of FIG. 7 to modulate the data and supplies the modulated data R'G'B' to the timing controller 21.

Although the data stretching part and the operating method thereof have been explained in relation to driving a liquid crystal display (LCD) device, the apparatus and method according to the present invention may be used with other display devices, such as plasma display panel (PDP) devices, organic light emitting diode (OLED) display devices, and field emission display (FED) devices, just to name a few.

As described above, the liquid crystal display device and the fabricating method thereof according to the present invention sets the minimum gradient and maximum gradient of the data stretching curve and sets the histogram to be divided into the plurality of gray level areas so as to determine the gradient of the data stretching curve to modulate the data in proportion to the accumulated total pixel number within each gray level area, thereby enabling the detailed gray level expression in any image. The liquid crystal display device and the driving method thereof according to the exemplary embodiments of the present invention modulates the data in accordance with the histogram analysis result of the image to solve the problem of difficulty in obtaining detailed expression of an image due to the overall brightness increase of the backlight when controlling the brightness of the backlight, particularly through the optimization of the data stretching curve.

It will be apparent to those skilled in the art that various modifications and variations can be made in the method and apparatus for driving a liquid crystal display device of the present invention without departing form the spirit or scope of the invention. Thus, it is intended that the present invention cover the modifications and variations of this invention provided they come within the scope of the appended claims and their equivalents.

What is claimed is:

1. An apparatus for driving a display device, comprising:

a histogram calculator to calculate a histogram of pixel data for an input image;

a data stretching curve generator, which divides the histogram into n gray level areas, generates a data stretching curve for each gray level area having a gradient proportional to a total number of pixel data accumulated for each of the gray level areas, connects each data stretching curve by connecting a end point of a data stretching curve in the preceding gray level area to a starting point of a data stretching curve in the following gray level area, and modulates the pixel data of the input image by mapping the pixel data of the input image to the connected data stretching curves;

a backlight unit irradiating a light to the display device; and a backlight controller controlling the backlight unit response to a control signal from the data stretching curve generator, wherein the backlight controller controls the output of the backlight unit in response to the control signal to supply to the backlight the driving dimming signal for increasing the brightness of the backlight for a bright image and decreasing the brightness of the backlight for a relatively dark image, wherein the data stretching curve generator generates the control signal corresponding to the calculated data from the histogram calculator, wherein the data stretching curve generator selects a data stretching curve of a pre-set minimum gradient in an area where the pixel data number is smaller than a minimum critical value in the histogram and a data stretching curve of a pre-set maximum gradient in an area where the pixel data number is greater than a maximum critical value, wherein n is a positive integer above 2, and wherein each gradient has a different value in proportion to the total number of pixel data for each gray level area and is defined as:

gradient=output gray level/input gray level, wherein the gradient of the data stretching curve is determined between the pre-set maximum gradient and the pre-set minimum gradient.

2. The apparatus according to claim 1, wherein the maximum gradient is between approximately 1.3 and approximately 1.7 and the minimum gradient is between approximately 0.55 and approximately 0.95.

3. The apparatus according to claim 2, wherein the maximum gradient is 1.5 and the minimum gradient is 0.75.

4. The apparatus according to claim 1, wherein the data stretching curve generator connects the gradient for each of the gray level areas, wherein the gradient of an mth gray level area is shifted so that an end point of the gradient of the mth gray level area is connected to the starting point of the gradient of an (m+1)th gray level area, where m is an integer from 1 to n−1.

5. A liquid crystal display device, comprising:

a liquid crystal display panel;

a histogram calculator to calculate a histogram of pixel data for an input image;

a data stretching curve generator, which divides the histogram into n gray level areas, generates a data stretching curve for each gray level area having a gradient proportional to a total number of pixel data accumulated for each of the gray level areas, connects each data stretching curve by connecting a end point of a data stretching curve in the preceding gray level area to a starting point of a data stretching curve in the following gray level area, and modulates the pixel data of the input image by mapping the pixel data of the input image to the connected data stretching curves;

a backlight unit irradiating a light to the liquid crystal display panel;

a backlight controller controlling the backlight unit response to a control signal from the data stretching curve generator;

a data driver to supply the modulated pixel data to the liquid crystal display panel;

a gate driver to supply a scan pulse to the liquid crystal display panel; and a timing controller to supply the modulated pixel data to the data driver and control the data driver and the gate driver, wherein the backlight controller controls the output of the backlight unit in response to the control signal to supply to the backlight the driving dimming signal for increasing the brightness of the backlight for a bright image and decreasing the brightness of the backlight for a relatively dark image, wherein the data stretching curve generator generates the control signal corresponding to the calculated data from the histogram calculator, wherein the data stretching curve generator selects a data stretching curve of a pre-set minimum gradient in an area where the pixel data number is smaller than a minimum critical value in the histogram and a data stretching curve of a pre-set maximum gradient in an area where the pixel data number is greater than a maximum critical value, wherein the data stretching curve generator and the timing controller are integrated together, wherein n is a positive integer above 2, and wherein each gradient has a different value in proportion to the total number of pixel data for each gray level area and is defined as:

gradient=output gray level/input gray level, wherein the gradient of the data stretching curve is determined between the pre-set maximum gradient and the pre-set minimum gradient.

6. A driving method of a liquid crystal display device, comprising the steps of:

dividing a histogram into n gray level areas;

calculating a total number of pixel data of an input image for each gray level area;

generating a data stretching curve for each gray level area having a gradient proportional to the total number of pixel data accumulated for each of the gray level areas and a control signal for controlling a brightness of a backlight unit in accordance with the histogram;

connecting each data stretching curve by connecting a end point of a data stretching curve in the preceding gray level area to a starting point of a data stretching curve in the following gray level area;

modulating the pixel data of the input image by mapping the pixel data of the input image to the connected data stretching curves; and controlling the brightness of the backlight unit response to the control signal, wherein n is a positive integer above 2, and wherein each gradient has a different value in proportion to the total number of pixel data for each gray level area is defined as:

gradient=output gray level/input gray level, wherein the gradient of the data stretching curve is determined between the pre-set maximum gradient and the pre-set minimum gradient.

7. The driving method according to claim 6, wherein the maximum gradient is between approximately 1.3 and approximately 1.7 and the minimum gradient is between approximately 0.55 and approximately 0.95.

8. The driving method according to claim 7, wherein the maximum gradient is 1.5 and the minimum gradient is 0.75.

9. The driving method according to claim 6, wherein the step of generating the data stretching curve includes connecting the gradient for each of the gray level areas by shifting the gradient of an mth gray level area so that an end point of the gradient of the mth gray level area is connected to the starting point of gradient of an (m+1)th gray level area, where m is an integer from 1 to n−1.

* * * * *